US007156378B2

(12) United States Patent
Maclaren

(10) Patent No.: US 7,156,378 B2
(45) Date of Patent: Jan. 2, 2007

(54) AIR SEAL ENCLOSURE FOR AN AERATOR

(76) Inventor: David S. Maclaren, 6805 Mayfield Rd., Apt. 1525, Mayfield, OH (US) 44124

( * ) Notice: Subject to any disclaimer, the term of this patent is extended or adjusted under 35 U.S.C. 154(b) by 0 days.

(21) Appl. No.: 11/037,412

(22) Filed: Jan. 18, 2005

(65) Prior Publication Data

US 2005/0189662 A1 Sep. 1, 2005

Related U.S. Application Data

(63) Continuation-in-part of application No. 10/961,566, filed on Oct. 8, 2004.

(60) Provisional application No. 60/536,623, filed on Jan. 15, 2004, provisional application No. 60/510,512, filed on Oct. 10, 2003.

(51) Int. Cl.
*B01F 3/04* (2006.01)

(52) U.S. Cl. ..... 261/87; 261/91; 261/93

(58) Field of Classification Search ..... 261/84, 261/87, 91, 93
See application file for complete search history.

(56) References Cited

U.S. PATENT DOCUMENTS

| | | | | |
|---|---|---|---|---|
| 2,280,979 | A * | 4/1942 | Rocke | 261/36.1 |
| 2,828,114 | A * | 3/1958 | Raudszus | 261/33 |
| 4,505,813 | A | 3/1985 | Graves | |
| 4,539,498 | A * | 9/1985 | Wilkes | 310/87 |
| 4,608,157 | A | 8/1986 | Graves | |
| 5,160,667 | A * | 11/1992 | Gross et al. | 261/91 |
| 5,316,668 | A | 5/1994 | Tang | |
| 5,389,310 | A * | 2/1995 | Leiponen | 261/87 |
| 5,484,524 | A | 1/1996 | Maclaren et al. | |
| 5,599,452 | A | 2/1997 | Maclaren et al. | |
| 5,667,689 | A | 9/1997 | Graves | |
| 2002/0102164 | A1 * | 8/2002 | Osadchuk | 417/234 |

OTHER PUBLICATIONS

JET, Inc., "Owner's Manual: 1500 Series BAT Media Plants", Manual, JET, Inc. 2003.
"JET's Air Seal Diffuser", Internet Webpage, http://www.stwastewater.com/diffuser.htm.

* cited by examiner

*Primary Examiner*—Scott Bushey
(74) *Attorney, Agent, or Firm*—Roberts Mardula & Wertheim, LLC

(57) ABSTRACT

The design of an air seal enclosure of the system and method of the present invention includes a combination of use of a multisurface silicone sealant between the bottom endbell and the air seal enclosure to provide a watertight joint that prevents water from entering the air seal enclosure. The air seal enclosure is formed from a suitable flexible material and is attached to a bottom endbell with bolts through holes in a periphery thereof. When tank liquid rises during flooding, the air seal enclosure provides a pocket of trapped air like a diving bell that prevents the tank liquid from ever reaching the bottom of the aerator.

8 Claims, 3 Drawing Sheets

AIR SEAL ENCLOSURE FOR AN AERATOR

RELATED APPLICATIONS

The present application claims priority to U.S. Provisional Application Ser. No. 60/536,623 filed Jan. 15, 2004, which is hereby incorporated by reference for all purposes, and is a continuation-in-part of copending U.S. application Ser. No. 10/961,566 filed Oct. 8, 2004, which claims the benefit of U.S. Provisional Application Ser. No. 60/510,512, filed Oct. 10, 2003.

FIELD OF THE INVENTION

The present invention relates generally to an air seal enclosure for an aerator. In particular, the present invention is directed toward an air seal enclosure that provides a pocket of trapped air like a diving bell during flooding to prevent tank liquid from ever reaching the bottom of an aerator used for sewage and wastewater treatment. Doing so helps to prevent damage caused by flooding of the treatment plant, as further disclosed in copending application Ser. No. 10/961,566.

BACKGROUND

Commonly assigned U.S. Pat. No. 5,316,668 to Tang discloses a wastewater treatment plant comprising a pre-treatment chamber, aeration chamber and a settling chamber designed to minimize or eliminate sludge buildup at the bottom of the aeration chamber. Two support walls are provided. The combined function of one support wall and an angular portion at the bottom of the common wall between the aeration and settling chamber is to regulate the flow pattern in the aeration chamber and return settled biodegradable matter from the bottom of the settling chamber to the aeration chamber for further treatment. The fluid flow created by the wall structure enhances the action of the settling chamber and eliminates dead zones in the aeration chamber thus minimizing sludge buildup.

Commonly assigned U.S. Pat. No. 5,484,524 to MacLaren et al. discloses a similar wastewater treatment plant for removal of organic matter, suspended solids and other pollutants comprising a pre-treatment chamber, a biofilm-aeration chamber and a settling chamber. Biofilm grows on biofilm support structure that is stationary and submerged in the mixed liquor of the biofilm aeration chamber. The combination of submerged or surface aeration and suspended solids particle size reduction occurs thereby creating a sufficient fluid flow within the biofilm aeration chamber. This combination of sufficient fluid flow, and reduced size suspended organic particles results in the efficient digestion of organic matter and pollutants by the biofilm growing on the biofilm support structure submerged in the biofilm aeration chamber. This results in a vastly more effective digestive process than conventional processes producing no sludge. Further, resulting treated effluent has a high dissolved oxygen content and low biochemical oxygen demand (BOD) and suspended solids (SS).

This type of treatment system provides effective wastewater treatment before effluent is discharged to an appropriate disposal area. In many parts of the country, disinfected effluent is discharged directly to open drainage ditches or streams. For example, the JET series 1500 treatment system, available from JET Inc. of 750 Alpha Dr. Cleveland, Ohio, has been rigorously tested by the National Sanitation Foundation. The system achieves NSF 40 Class 1 effluent quality, i.e., an effluent quality consistently better than 30 mg/L BOD and 30 mg/L TSS. In Massachusetts, the system is approved for use to repair failed or failing septic systems. The remedial use permit allows certain reductions of Title 5 leaching area requirements. This system is particularly well suited for use where small lots, high groundwater, and/or poor soils are encountered and is currently undergoing pilot testing and achieves some nitrogen and phosphorus removal.

In operation, the system utilizes a motor driven aspirator shaft that thoroughly mixes and disperses fine air bubbles into the aerobic chamber of the treatment tank. This is an activated sludge system, which uses both suspended and fixed growth bacteria to achieve secondary biological treatment. The aeration chamber capacity of 650 gallons for the above-mentioned JET system allows a detention time of more than 30 hours at design flow of 500 gallons per day. Larger systems can handle higher flows. The benefits of such systems include: superior effluent quality, dramatically reduced need for further wastewater treatment; reduced leaching area, or direct effluent discharge after disinfection; decreased separation to groundwater; effective use of poor soil conditions; and increased the life expectancy of the leach area due to discharge of high quality effluent.

Commonly assigned U.S. Pat. No. 5,599,452 to MacLaren et al. discloses another wastewater treatment system that relies on aeration.

U.S. Pat. No. 5,667,689 to Graves discloses a wastewater treatment apparatus that includes at least an aeration chamber and a clarification chamber having a common wall therebetween, a transfer port opening through the common wall between a lower portion of the clarification chamber and the aeration chamber, an aerator mechanism in the aeration chamber for creating wastewater flow currents which flow through an inlet portion of a flow augmenting device located in the common wall above the transfer port. The flow augmenting device is a conduit or pipe having a discharge outlet adjacent the lower portion of the clarification chamber through which exits the flow from the aeration chamber resulting in solid particles being agitated and returned from the clarification chamber lower portion into the aeration chamber through the transfer port. It uses a conventional aerator design.

U.S. Pat. No. 4,608,157 to Graves discloses a wastewater treatment plant which includes pretreatment, aeration, final clarification and overflow/backwash chambers adapted to receive a fluid, such as home wastewater, which is to be subjected to extended aeration or aerobic digestion, the aeration chamber including an aerator having a shaft whose lower end is normally received in the fluid which is to be treated, an aerator foam deflector carried by the shaft which under abnormally high fluid levels increases the torque on the shaft and, thus, indicates abnormal operation, the final clarification chamber including a demand use filter, an overflow outlet operative should the filter become disabled, and a backwash nozzle located in the filter by reverse pumping therethrough fluid pumped from the overflow or backwash chamber. It uses a conventional aerator design.

U.S. Pat. No. 4,505,813 to Graves discloses a wastewater treatment plant which includes pretreatment, aeration, final clarification and overflow/backwash chambers adapted to receive a fluid, such as home wastewater, which is to be subjected to extended aeration or aerobic digestion, the aeration chamber including an aerator having a shaft whose lower end is normally received in the fluid which is to be treated, an aerator foam deflector carried by the shaft which under abnormally high fluid levels increases the torque on the shaft and, thus, indicates abnormal operation, the final clarification chamber including a demand use filter, an overflow outlet operative should the filter become disabled, and a backwash nozzle located in the filter by reverse pumping therethrough fluid pumped from the overflow or backwash chamber. It also uses a conventional aerator design.

In these systems, the primary moving part is the motor driven aerator and water damage is the most common cause of aerator repairs. This damage occurs when the water level in the tank rises to a point where it contacts the aerator and occurs most frequently when there is a blockage of the tank outlet.

Although one method to avoid water damage caused by outlet blockage is the installation of an overflow valve, use of these valves is not always possible and, even when used, these valves are subject to blockage and can be overwhelmed by heavy flooding.

FIG. 1 shows a typical aerator design of the prior art. In this system there are multiple locations where leakage can occur. The seal between the top enclosure and the top endbell is a major leak point in this type of aerator. During a flood of the plant, water rises through the aspirator, aspirator shaft and rotor shaft and spills over the top of the rotor shaft. The rubber disk that seals between the top enclosure and the top endbell does not seal around the rotor shaft at location 1. This provides an open path for liquid to run freely into the interior of the motor.

The thru bolts are another leak point in this type of aerator. When liquid rises to the level of the top of the top endbell, liquid would run between the top enclosure and the top endbell and enter the cavities around the thru bolt heads at 2 and drain down into the motor because the seal washers under the screw heads fail to provide an effective seal.

Another leak point 3 is between the endbells and the stator shell. There is no O-ring seal between the endbells and the stator shell. This area is generally assembled by the motor manufacturer and relies on material applied on the rotor shell edges that dries up and becomes a leak point over time.

Yet another leak point is the lower seal. No grease is applied to the lower seal beneath the bottom bearing shortening the seal life. When the seal wears down, as it always will, it will begin to leak air out of the air seal enclosure, negating the diving bell effect and providing another leak point at location 4.

What is needed is a water resistant aerator that resists leaking and water damage, making the aerator longer lasting, less prone to damage from blockage, and more resilient to wet environments.

SUMMARY OF THE INVENTION

The air seal enclosure for an aerator design of the present invention includes a combination of waterproofing techniques for wastewater aerators, including but not limited to: use of a multisurface silicone sealant between the bottom endbell and the air seal enclosure to provide a watertight joint that prevents water from entering the air seal enclosure from the side; use of a bottom lip seal or lower grease seal or both to make the top of the air seal enclosure airtight; and use of an air seal enclosure that traps air in a manner like a diving bell when liquid levels begin to flood the aerator.

DETAILED DESCRIPTION OF THE INVENTION

In a preferred embodiment, a water resistant aerator and a method for waterproofing it includes an air inlet cover over an air inlet plate to collect the aeration air. For the body of the aerator, a top endbell is attached to a top end of a stator shell and a bottom endbell attached to a bottom end of the stator shell. A motor is enclosed within the body and a hollow rotor shaft is mounted on a top bearing in the top endbell and a bottom bearing in the bottom endbell. The rotor shaft is coupled to said inlet plate at a first end, passes through the top endbell to the motor and from the motor through the bottom endbell where it is coupled to an aspirator shaft at a second end. An air seal enclosure of the present invention is located between the bottom endbell and the rotor shaft.

For waterproofing, the water resistant aerator further comprises top and bottom lip seals between the endbells and the rotor shaft, the lip seals each being a single lip seal with at least 18 degrees of wear motion before pressure is lost. A grease seal is located between the each lip seal and each bearing. A multi-surface silicone sealant is preferably applied between the bottom endbell and the air seal enclosure. O-ring seals can be located between the top and bottom endbells and the stator shell.

At the upper portion of the aerator, a lifting handle couples the rotor shaft to the air inlet plate, wherein the lifting handle includes a threaded attachment to the top endbell and the threaded attachment included thread sealing compound. Additionally, a plurality of bolts are used to secure a periphery of the top and bottom endbells to each other, wherein the bolts are located outside the stator shell so as not to introduce through-holes that can leak.

Preferably, the top and bottom bearings are pre-lubricated sealed bearings that have a running seal on either side. To prevent drawing water droplets into the aerator, the air inlet plate preferably has openings with a combined cross-sectional area at least 4½ times larger than the cross-sectional area of the hollow portion of the rotor shaft. Locating the air inlet plate 1/16" (1.6 mm) below the air inlet cover helps keep insects and other debris out of the aerator.

Figure 1:
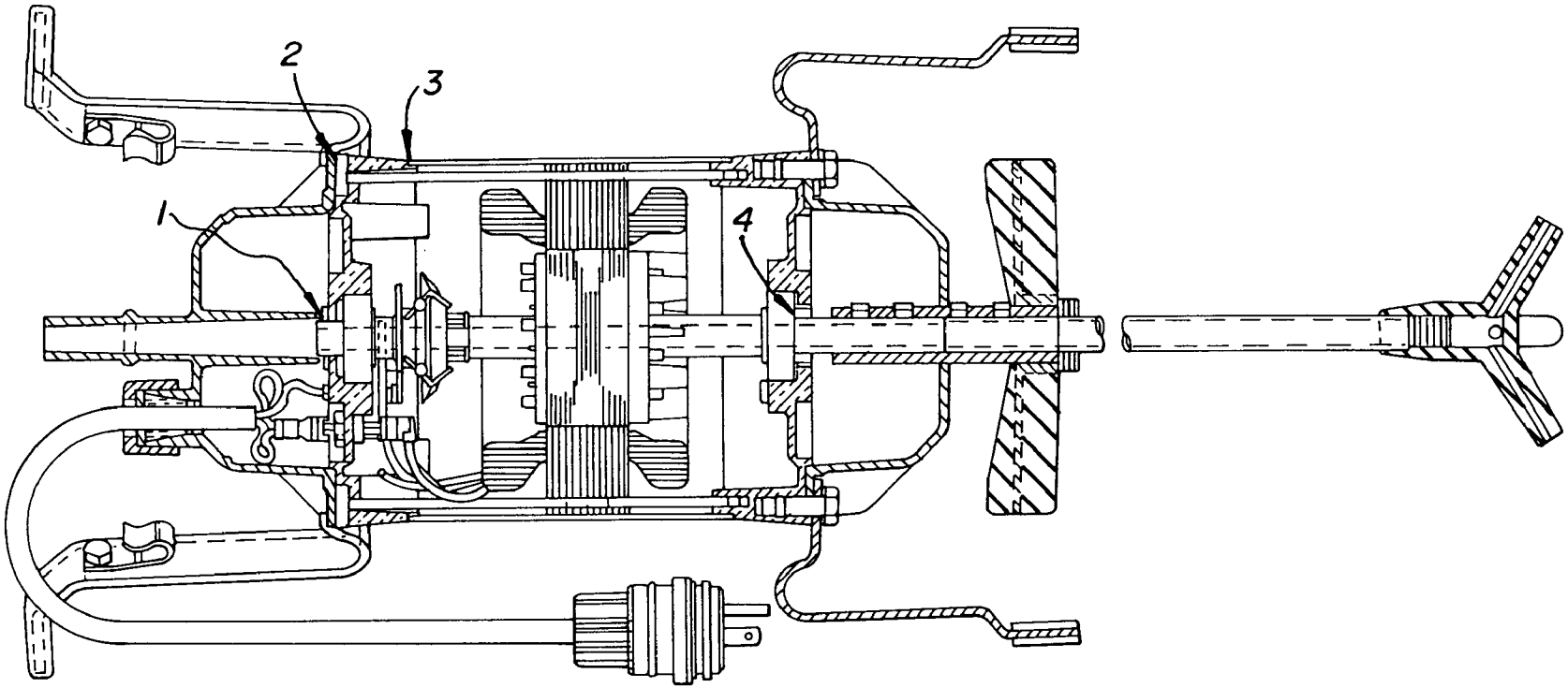
FIG. 1 PRIOR ART
FIG. 1 illustrates a prior art aerator design.
Figures 2, 3:
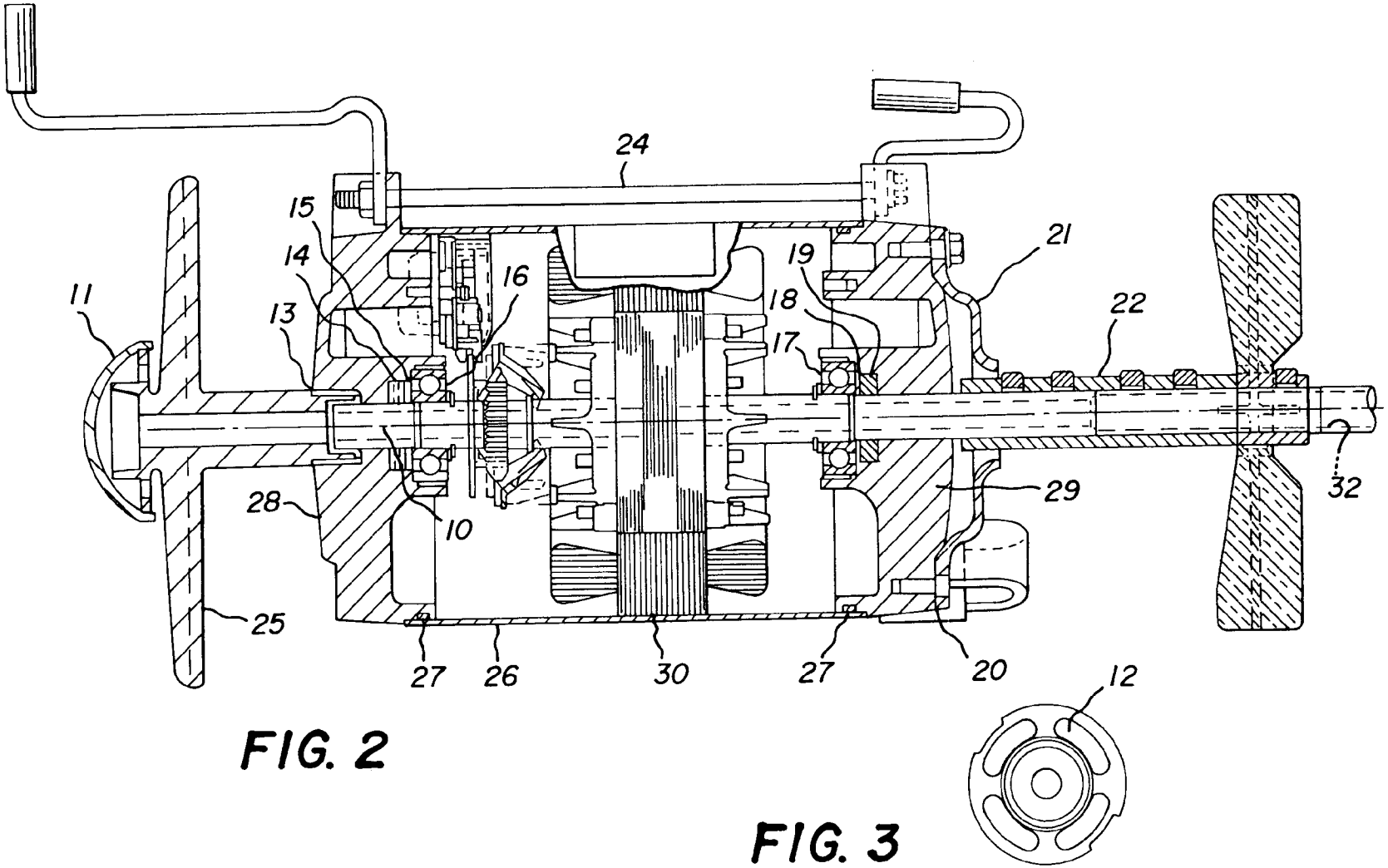
FIG. 2 illustrates one embodiment of an aerator using the air seal enclosure of the present invention.
FIG. 3 illustrates an air inlet plate used in one embodiment of an aerator using the air seal enclosure of the present invention.

FIG. 2 illustrates a cross sectional view one embodiment of the water resistant aerator using the air seal enclosure of the present invention. In use, aeration air enters through an air inlet cover 11 through an air inlet plate 12 to a hollow rotor shaft 10. The rotor shaft 10 passes through a top endbell 28 to the motor 30 and, from the motor 30, though a bottom endbell 29 to feed air to an aspirator shaft 32 coupled thereto by coupling 22. The rotor shaft 10 is mounted via bearings 16, 17 in each endbell 28, 29 and has a seal 15, 18 associated with each endbell.

Figure 4:
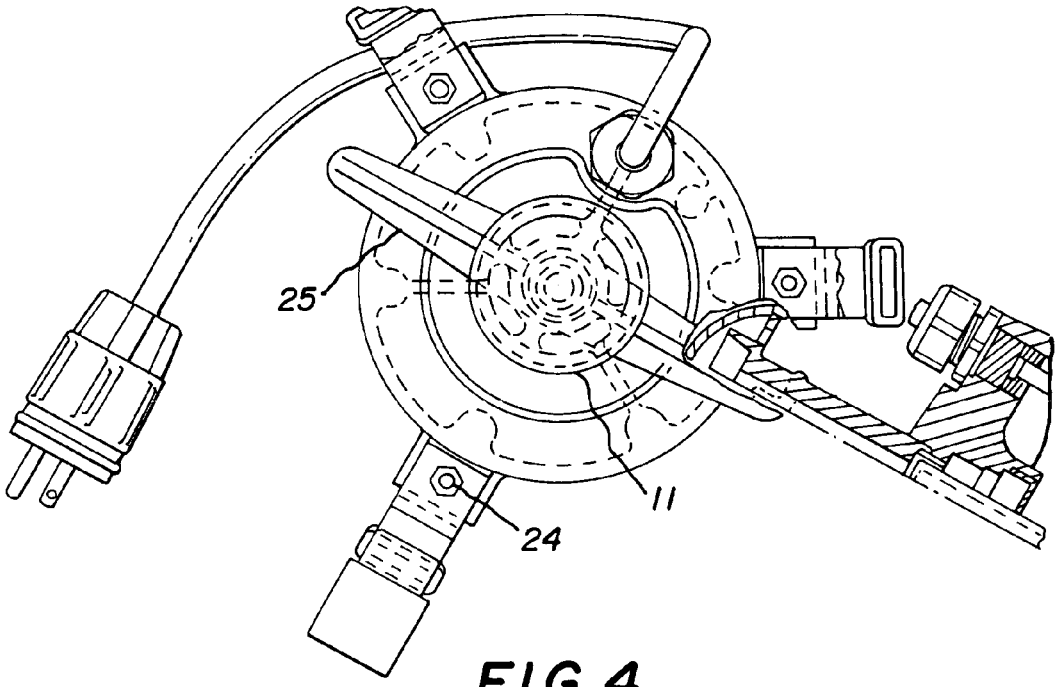
FIGS. 4–5 illustrate end views of one embodiment of an aerator using the air seal enclosure of the present invention.
Figure 5:
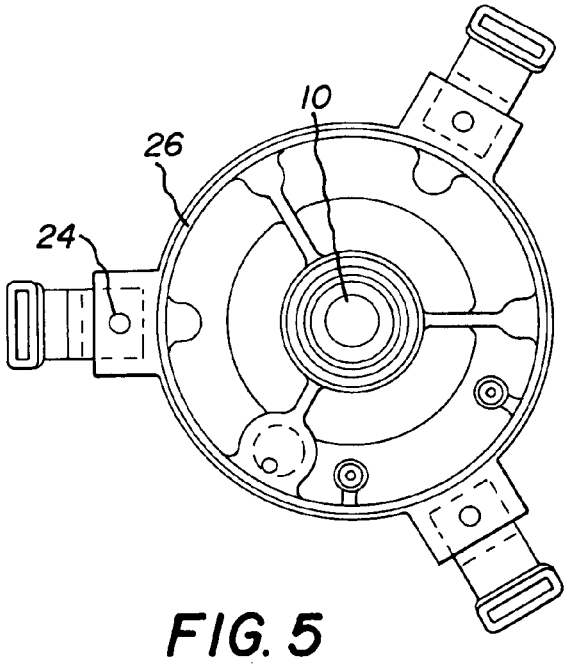

Various waterproofing details are provided in combination with the present invention to allow the aerator to be water resistant, as disclosed in copending Provisional Application Ser. No. 60/510,512. The air inlet cover 11 prevents any water that enters the plant through the vent cap due to hard rains or lawn sprinkling from entering the aerator. As shown in FIGS. 3 and 4, the air inlet plate 12 above the handle 25 has openings that are 4½ times the area of the opening in the rotor shaft 10. This results in low velocity air intake that is unlikely to pull in moisture droplets or airborne objects. The top of air inlet is only 1/16" below the air inlet cover to further prevent objects and insects from entering the rotor and aspirator shafts. FIG. 5 illustrates the other end of the water resistant aerator shown in FIG. 2.

The threaded joint 13 between the lifting handle 25 and the top endbell 28 has a thread sealing compound applied to provide a watertight connection between these two parts.

The top lip seal 14 is a single lip seal with over 18 degrees of wear motion before pressure is lost. At that point, a very large seal to shaft surface interface exists to impede the flow of moisture into the motor's interior. As illustrated in FIG. 2, O-rings 27 can be provided between the endbells 28, 29 and the stator shell 26 to waterproof the joints. Although illustrated with two O-rings, it is possible that the stator shell 26 can be integrated with one of the endbells 28, 29 so that only a single O-ring is required.

As illustrated in FIG. 2, the air seal enclosure 21 is secured to the bottom endbell 29 at a periphery thereof and is shaped to form an end wall spaced in close proximity to the endbell 29 that is substantially parallel to the bottom endbell 29. The end wall has a small opening for the aspirator shaft, though which air is forced into the air seal enclosure 21 as a liquid level rises. The hole preferably includes a small, downwardly extending lip and has a clearance with respect to coupling 22.

A grease-filled space, also referred to as a grease seal 15, is provided between the top lip seal 14 and the top bearing 16 to impede moisture from entering the motor 30. Similarly, there is another grease seal 18 provided between the bottom bearing 17 and the bottom lip seal 19 to impede moisture from entering the motor 30. The top bearing 16 is a sealed bearing. This top bearing 16 has a running seal on either side, is pre-lubricated, and moisture cannot pass through. Likewise, the bottom bearing 17 is a sealed bearing. The bottom bearing 17 also has a running seal on either side and is pre-lubricated such that moisture cannot pass through the bearing.

The bottom lip seal 19 is a single lip seal with over 18 degrees of wear motion before pressure is lost. At that point a very large seal-to-shaft surface interface exists to impede the flow of moisture into the motor's interior. Multi-surface silicone sealant provides a watertight joint 20 between the bottom endbell 29 and the air seal enclosure 21 to prevent water from entering the air seal enclosure 21. The air seal enclosure 21 is preferably made of a suitable flexible, non-corrosive, water-impermeable material and is dimensioned to extend over the endbell to seal against the aerator shaft or its coupling. The air seal enclosure 21 provides a pocket of trapped air like a diving bell that prevents the tank liquid from ever reaching the bottom of the aerator. The entire aerator is preferably painted on the exterior to further seal all joints and give enhanced corrosion resistance, although this is not a requirement.

The bolts 24 extending between the top and bottom endbells 28, 29 are preferably located outside of the stator shell 26 so that they no longer act as a potential leak site. Bolts in the bottom endbell 29 are used to secure the air seal enclosure 21 of the present invention via holes in a periphery thereof.

The only place where liquid can reach the interior of the motor is if the liquid level of the tank rises during a flood to the point that it comes up through the aspirator, aspirator shaft 32, and rotor shaft 10 to spill out over the top of the rotor shaft 10. In one embodiment, this flood point is 9¾" (24.8 cm) above the top of the tank interior and 21¾" (55.2 cm) above the normal operating level of the plant. However, even if flooding occurs to that level, moisture entry into the electrical interior of the motor 30 will be prevented by the lip seal 14, the grease seal 15, and the sealed bearing 16.

In use, as discussed above, when the tank liquid level reaches the bottom of the aerator, the air seal enclosure 21 provides a pocket of trapped air like a diving bell that prevents the tank liquid from ever reaching the bottom of the aerator. The lower pressure seals (lip or grease or both) on the rotor shaft 10 and the multi-surface silicone sealant serve to keep the trapped air in the air seal enclosure 21. The air seal enclosure 21 can further be optionally shaped such that when the liquid pressure acts against the outside thereof, it can collapse and form a seal against the rotor shaft 10. In this manner, the tank liquid is kept away from the aerator during flooding.

In one embodiment, the present invention comprises an air seal enclosure for an aerator which has the air seal enclosure between the bottom endbell and the rotor shaft with holes in a periphery of the air seal enclosure for mounting to said endbell, wherein the air seal enclosure is formed of a suitable flexible material.

In another embodiment, the air seal enclosure further includes a multi-surface silicone sealant applied between the bottom endbell and the air seal enclosure.

Another embodiment of the present invention is to a method of waterproofing a wastewater aerator with an air seal enclosure, comprising providing an air seal enclosure between a bottom endbell and a rotor shaft of said aerator. The method can further comprise applying a multi-surface silicone sealant between the bottom endbell and the air seal enclosure.

In another method embodiment, the air seal enclosure is attached to the endbell with bolts through holes in a periphery of the air seal enclosure.

Another embodiment of the present invention includes forming the air seal enclosure from a suitable flexible material.

A system and method for creation and use of a water resistant air seal enclosure for an aerator has been described. It will be understood by those skilled in the art that the present invention may be embodied in other specific forms without departing from the scope of the invention disclosed and that the examples and embodiments described herein are in all respects illustrative and not restrictive. Those skilled in the art of the present invention will recognize that other embodiments using the concepts described herein are also possible. Further, any reference to claim elements in the singular, for example, using the articles "a," "an," or "the" is not to be construed as limiting the element to the singular.

I claim:

1. An air seal enclosure for an aerator comprising:

an air seal enclosure between a bottom endbell and a rotor shaft, holes in a periphery of said air seal enclosure for mounting to said bottom endbell, and a central opening in said air seal enclosure with clearance for the rotor shaft;

wherein the air seal enclosure is formed of a suitable non-corrosive, water-impermeable material and is shaped to form an end wall substantially parallel to said bottom endbell in close proximity to said bottom endbell to trap air therein when a tank liquid level rises.

2. The air seal enclosure for an aerator of claim 1, further comprising: multi-surface silicone sealant applied between the bottom endbell and the air seal enclosure.

3. A method of waterproofing an aerator with an air seal enclosure, comprising:

providing an air seal enclosure between a bottom endbell and a rotor shaft of said aerator;

including a central opening in said air seal enclosure with clearance for the rotor shaft, shaping the air seal enclosure to form an end wall substantially parallel to said bottom endbell in close proximity to said bottom endbell, and trapping air within the air seal enclosure when a tank liquid level rises.

4. The method of claim 3, further comprising:

applying multi-surface silicone sealant between the bottom endbell and the air seal enclosure.

5. The method of claim 3, further comprising:

attaching said air seal enclosure to said endbell with bolts through holes in a periphery thereof.

6. The method of claim 3, further comprising:

forming said air seal enclosure from a suitable non-corrosive, water-impermeable material.

7. The method of claim 3, further comprising:

using said aerator for wastewater treatment.

8. The method of claim 3, further comprising:

including a downwardly depending lip on said central opening.

* * * * *